US008714265B2

(12) United States Patent
Vestavik

(10) Patent No.: US 8,714,265 B2
(45) Date of Patent: May 6, 2014

(54) DOWN HOLE VALVE DEVICE

(75) Inventor: Ola M. Vestavik, Eggesbones (NO)

(73) Assignee: Reelwell AS (NO)

( * ) Notice: Subject to any disclaimer, the term of this patent is extended or adjusted under 35 U.S.C. 154(b) by 358 days.

(21) Appl. No.: 13/121,689

(22) PCT Filed: Sep. 30, 2009

(86) PCT No.: PCT/NO2009/000339

§ 371 (c)(1),
(2), (4) Date: Mar. 30, 2011

(87) PCT Pub. No.: WO2010/039042

PCT Pub. Date: Apr. 8, 2010

(65) Prior Publication Data

US 2011/0180269 A1 Jul. 28, 2011

(30) Foreign Application Priority Data

Oct. 1, 2008 (NO) ..... 20084145

(51) Int. Cl.
*E21B 34/12* (2006.01)

(52) U.S. Cl.
USPC ..... 166/373; 166/325; 166/334.4; 166/332.1

(58) Field of Classification Search
USPC ..... 166/332.1, 334.1, 321, 325, 334.4, 386, 166/373, 374, 375
See application file for complete search history.

(56) References Cited

U.S. PATENT DOCUMENTS

| | | | | | |
|---|---|---|---|---|---|
| 1,730,051 | A | * | 10/1929 | Bennett | 417/143 |
| 2,647,583 | A | * | 8/1953 | Kriegel | 166/146 |
| 2,762,440 | A | * | 9/1956 | Reed | 166/154 |
| 2,787,327 | A | * | 4/1957 | Pearson | 166/99 |
| 2,805,043 | A | * | 9/1957 | Williams, Jr. | 175/317 |
| 2,831,539 | A | * | 4/1958 | En Dean et al. | 166/73 |
| 2,875,775 | A | * | 3/1959 | Cummings | 137/155 |
| 2,915,127 | A | * | 12/1959 | O'Farrel | 166/99 |

(Continued)

FOREIGN PATENT DOCUMENTS

GB 1108120 4/1968

OTHER PUBLICATIONS

Command Controls Corp.: "minicatalog Mar. 2006" [online] Mar. 31, 2006, retrieved from ther Internet: www.commandcontrols.com/minicat/minicatalog.pdf Retreived on Dec. 15, 2009.

(Continued)

*Primary Examiner* — Kenneth L Thompson
(74) *Attorney, Agent, or Firm* — Adenike Adebiyi

(57) ABSTRACT

The present invention regards a valve device for use with a down hole tool comprising at least a first fluid line and a return fluid line, the valve device comprises a first inlet and a first outlet forming a first flow path between them, and a second inlet and a second outlet forming a second flow path between them, at least one closure element for closing and or opening at least one of the flow paths. According to the invention there is at least one closure element together with the respective flow paths forms a first and second check valves, which in a first state prevents a fluid from flowing from the first outlet to the first inlet and a fluid from flowing from the second inlet to the second outlet. The invention also regards a method for operating a down hole valve device.

9 Claims, 4 Drawing Sheets

(56) References Cited

U.S. PATENT DOCUMENTS

| | | | | |
|---|---|---|---|---|
| 3,268,017 | A * | 8/1966 | Yarbrough | 175/25 |
| 3,464,633 | A * | 9/1969 | Potocnik | 239/425 |
| 3,664,415 | A * | 5/1972 | Wray et al. | 166/336 |
| 3,978,923 | A * | 9/1976 | Ford | 166/325 |
| 4,509,606 | A * | 4/1985 | Willis | 175/69 |
| 4,754,820 | A | 7/1988 | Watts | |
| 5,680,049 | A | 10/1997 | Gissler | |
| 7,090,018 | B2 | 8/2006 | Livingstone | |
| 7,108,080 | B2 * | 9/2006 | Tessari et al. | 175/21 |
| 7,647,989 | B2 * | 1/2010 | Chan et al. | 175/57 |
| 2004/0112644 | A1 * | 6/2004 | Chan et al. | 175/57 |
| 2004/0195007 | A1 | 10/2004 | Eppink | |
| 2005/0173125 | A1 * | 8/2005 | Naquin et al. | 166/373 |
| 2005/0224231 | A1 | 10/2005 | Surjaatmadja | |
| 2007/0018848 | A1 * | 1/2007 | Bottos et al. | 340/854.4 |

OTHER PUBLICATIONS

Search report from Norwegian Patent Application No. 20084145, dated Oct. 27, 2012.

* cited by examiner

DOWN HOLE VALVE DEVICE

FIELD

The present invention relates to a valve device for use in connection with the running of down hole tools and a method for operating a valve down hole.

BACKGROUND

For several activities performed down in the well there is a need for providing a fluid to the tool equipment and there is a need to return this fluid to the surface. One possible way of doing this is to use a dual bore from the surface and down to the tool in the well. This meaning one bore is used to transport the fluid down into the well and another bore is used to transport the fluid out of the well during the working process. The working process may be drilling, cleaning or lining of the bore hole or other activity or a combination of these activities.

In relation to this there is a need for controlling and guiding the flow of fluid in the well, and an aim with the present invention is to provide a device and method for achieving this.

According to the invention there is provided a valve device and a method for operating a valve device which solve this need.

SUMMARY

The invention regards a valve device for use with a down hole tool. The down hole tool preferably comprises means for connecting it to at least a first fluid line and a return fluid line. This tool may be a drilling tool, a cleaning tool, a lining tool or other kinds of tool or a combination of these. One possible use for the valve device is in connection with drilling with a double coaxial drilling pipe and a piston arrangement in the annular space between the drilling pipe and the well bore for pressure assisted drilling. The double coaxial drilling pipe will in one pipe form a flow path for fluid flowing down into the well and a return pipe will form a flow path for the return of the fluid up to the surface. The return pipe may be the central bore and the flow into the well may be in an annular space around this central bore. The valve device comprises a first inlet and a first outlet forming a first flow path between them, a second inlet and a second outlet forming a second flow path between them, and at least one closure element for closing and or opening at least one of the flow paths. The first flow path may be connected to the annular flow path of the dual drill pipe and the second flow path may be connected to the centre flow path of the dual drill pipe, or dual bore pipe string if the activity to be performed is another activity than drilling.

It is according to the invention possible that there is one element which acts as a closure element for two or more flow paths, it is also possible that there are different closure element for the different flow paths or some common and some separate. Normally there will be at least one closure element which will close off or open the two flow paths in the valve device. According to one aspect there may be one common closure element for these two flow paths. According to the invention the at least one closure element together with the respective flow paths forms a first and second check valves, which in a one state prevents a fluid from flowing from the first outlet to the first inlet and a fluid from flowing from the second inlet to the second outlet. This gives that the valve system will prevent a pressure build up in an area between the first outlet and the second inlet, from opening the valve system. The valve system may when this area is formed by the bottom of the well, act as a barrier. In such a system the first inlet and second outlet are connectable to a pipe string and the first outlet and second inlet are connectable to the tool. The down hole tool will normally be positioned between the first outlet and the second inlet. The first outlet will then normally lead to a tool, and the second inlet will normally lead a normal fluid flow from the tool. A fluid to the tool may then be sent down to the tool through the first flow path and returned through the second flow path. In one embodiment it is possible to reverse the flow of fluid through the valve system.

A check valve shall in this application be understood to be a valve which will, when it is not influenced by outside signals, in normal operations, or with other words in a first state act as a one-way valve, allowing fluid to flow in one direction with a given pre-set pressure difference between the two sides of the valve. The check valve will with other words open from a closed state if the pressure in the fluid on one side, a first side, of the valve exceeds a pressure as fluid is added to this first side of the valve. The check valve will further in normal operation, in this first state, prevent fluid from flowing the opposite way, i.e. a fluid flow from a second side to a first side of the valve. An increased pressure in the fluid on this opposite side may assist in providing a sealing in the valve. The check valve may as indicated, be controlled by outside signals to be in a given position, either an open or a closed position in a second state of the valve. When the check valve is controlled by outside signals the check valve may be said to be in a second state and then no longer act as a normal check valve but acting as a more normal valve. These signals may be electrical, magnetic, hydraulic or mechanical and come form other down hole tools, as other valves or be signals from the surface. The signals will keep the check valve in this state, but if these signals stop the valve will again act as a one-way valve, a check valve under normal operations.

According to an aspect of the invention the second check valve in the second flow path may be connected to the first check valve in the first flow path, and may be arranged to be in an open position when the first check valve is in an open position. The second check valve, positioned in the second flow path, will with an outside signal be in a second state and in this second state be in a forced open position. This outside signal may be a specific signal or it may be a signal which indicates that the first check valve in the first flow path is in an open position. By this a fluid may flow through the first check valve when there is a given pressure difference across the first check valve, and this pressure difference opens the first check valve. This will signal to the second check valve to be in a second state, which is a forced open state, and the fluid may flow in through the first flow path and out through the second flow path. When the first check valve is closed, the second check valve is again in the first state and operated as a normal check valve. By this the flow path down to the tool may be opened by providing a pressure difference across the first check valve in the first flow path, which then opens the second flow path through the valve device. When there is no positive pressure difference across the first check valve to open this check valve, the second check valve is in a first state, a normal check valve. A pressure build up around the tool will then not be allowed to cross the valve device, as it acts as a barrier. The valves may also be given their state by signals from the surface.

There may according to the invention also be a similar connection between the second check valve and the first check valve, giving that when the second check valve is experiencing a pressure difference across the valve such that it opens as a normal check valve, this will give signals to the first check valve to go into a second state where it is in a forced open state. By this a fluid may flow the opposite direction through the valve device. The fluid will then flow into the second outlet, and out through the second inlet and then in through the first outlet and out through the first inlet. When there is no positive pressure difference across the second check valve it will again close and the first check valve will return to a first state.

According to another aspect the valve device may comprise a connection flow path between the first and second flow paths. There may in this connection flow path be arranged a valve device with a closure element for closing and or opening this connection flow path. There may be more than one connection flow path. The signals operating the connection fluid valve may be electrical, hydraulically, mechanical, or other kinds. These signals may come from the operation of the other valves, the first or second check valves or as a signal from an operator or other tools used in connection with the work performed in the well.

According to another aspect the connection flow path may be arranged to connect an upstream side of the first check valve with a downstream side of the second check valve. By such an arrangement one may in a dual bore tool string provide circulation of the fluid in the tool string before fluid is given more pressure and the first or second check valve is opened, dependent on the circulation direction and the fluid is guided to the tool below the valve device.

According to another aspect the valve device may comprise at least one closure element for the connection flow path and the first and second flow paths. There may be one common closure element operating all three flow paths. There may be one closure element for two of the flow paths and a separate one for the third or one closure element for each of the flow paths. There may be one closure element operating both check valves. There may also be more than one closure element in a flow path, forming a double valve in that flow path. With one closure element for several flow paths this element may be one solid element or several element fixed and or linked together or even just abutting each other and thereby acting on each other, and thereby giving signals for operation of the valves in the flow paths.

The connection between the at least one closure element for the at least two of the at least two flow paths may be mechanical, electrical, hydraulically, magnetically, acoustical or other kind of connection, providing a signal for operation of the closure element in relation to one flow path in relation to the closure element in another flow path. These signals may then override the normal operations for the second valve, by this moving the valve from a first state to a second state, which in a first state normally act as a check valve, and which in a second state is a forces open valve.

According to the invention there is provided a valve device for use with a down hole tool comprising at least a first fluid line and a return fluid line in the tool string. The return fluid line may be coaxial with the first fluid line and arranged within the first fluid line forming a centrally return line and an annular first line. The valve device comprises a first inlet and a first outlet forming a first flow path between them, and a second inlet and a second outlet forming a second flow path between them. These first and second flow paths will be connected to the first line and the return line of the tool string. There will be at least one closure element for closing and or opening at least one of the flow paths. According to the invention the first inlet may be connected to an annular space in the tool string, the first outlet to a centrally space in the tool string, the second inlet to an annular space around the tool string and the second outlet to a centrally space in the tool string, forming flow paths in opposite directions in the two flow paths in the valve device. This arrangement may also be arranged to move an annular flow to a centrally location and an outside annular flow to a centrally flow line. There may be arranged valve elements in connection with the two flow paths through the valve device. The may be at least one closure element for closing off and or opening the at least two flow paths through the valve device. This will form two valves one in each of the flow paths through the valve device. These valve elements may be in the form of check valve as described above but may also be other kinds of valves.

According to the invention there is also provided a valve device for use with a down hole tool comprising at least a first fluid line and a return fluid line in the tool string. The valve device comprises a first inlet and a first outlet forming a first flow path between them, and a second inlet and a second outlet forming a second flow path between them, at least one closure element for closing and or opening at least one of the flow paths forming a first and second valve in the first and second flow path respectively. According to the invention the opening and or closing of the first and second valve may be operated by an axial movement of the at least one closure element. By axial movement one should understand a movement in the direction of an axis of the well bore wherein the valve device will be used. The axial movement may be combined with a rotational movement. This rotational movement may be around an axis substantially equal to an axis of the well bore wherein the valve device is used or it may be an axis other than that, either parallel to this axis or with an angle to this axis.

According to an embodiment of this aspect there is in addition a flow connection path between the first and the second flow path, arranged from the upstream side of the first flow path to the downstream side of the second flow path. In connection with the flow connection path there is arranged a fluid connection valve operated by a closure element. According to one aspect the closure element for the flow connection path may in addition be operated by an axial movement of the at least one closure element. This axial movement may be the same axial movement as the movement for operation of the valves in the first and second flow paths. The valves in the first and second flow paths may be of the kind defined above but may also be a different kind of valve. The operation of the closure element for the three valves may be a common closure element, mechanically connected closure element or operated by electrical, hydraulic, magnetically means to act in response to each other.

According to the invention there is also provided a method for operating a valve device for use with a well tool comprising at least two fluid lines, a first fluid line and a return line, with the valve device comprising means for opening and or closing of the first fluid line and means for opening and or closing of the return fluid line, i.e. by opening or closing the first and second flow path through the valve device, and means for opening or closing for fluid communication between the first fluid line and the return fluid line upstream of means for closing the first flow line and downstream of means for closing the return line when these fluid lines are closed. According to the invention the method for activation of the valve device comprises the steps of firstly closing the fluid communication between the first fluid line and the return fluid line, thereafter opening the return fluid line, and opening the first fluid line. This will with the described valve device mean closing of the fluid communication path, thereafter opening the second flow path and opening the first flow path. The deactivation of the valves device comprises of the same steps in reverse order, i.e. firstly closing of the first fluid line, then closing of the return fluid line and lastly opening the communication between the first fluid line and the return fluid line. These acts in relation to the valves in the first and second flow paths may be made more or less simultaneous.

If the pressure below the valve device when it is used in the well exceeds the pressure of the fluid supplied at the inlet of the first flow path, the first check valve will automatically close and thereby not making the second check valve stay open, which second check valve then also will close since it possibly is experiencing the same pressure from the well as the first check valve. There may then be a link to the fluid connection valve to open, providing for circulation between the first fluid line and the return fluid line above the closed check valves.

In case of a controlled closing of the fluid circulation down to the tools in the well, the deactivation of the valve will be performed by reducing the pressure in the circulation fluid at the first inlet thereby causing the first check valve to close, thereby closing the second check valve and opening the fluid connection valve. Alternatively the deactivation can be controlled by signals from surface or from another down hole tool.

According to an aspect of the invention the different steps of the method may be performed by moving one element in an axial direction. This element may for instance be a common closure element for all three valves.

BRIEF DESCRIPTION OF DRAWINGS

The present invention will now be explained with reference to the attached drawings, where.

DETAILED DESCRIPTION

Figure 1:
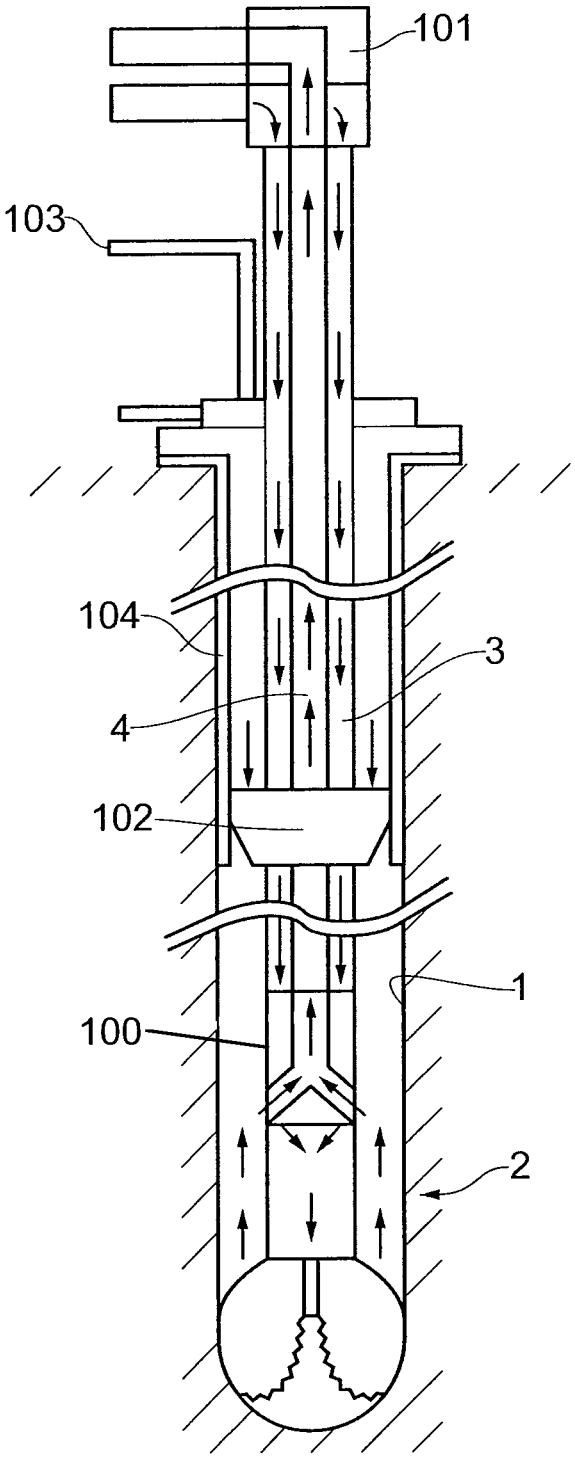
FIG. 1 shows the principle of a dual bore system with a valve device according to the invention.

The invention relates to a valve device 100 for use with a down hole tool 2 for use in a well bore 1. The valve device 100 is connected to a first fluid line 3 and a second fluid line 4 of the down hole tool 2. These fluid lines 3, 4 may as indicated in FIG. 1 be arranged concentrically, with the second fluid line 4 as a return line within the first fluid line 3. The down hole tool 2 may comprise a system with a piston 102 arranged in the annular space between the first fluid line 3 and the well bore 1. This piston 102 may be in abutment against a casing 104 positioned in the well bore. The annular space relatively above the piston 102 may be filled with a fluid and pressurized by a hydraulic system 103 to assist in moving the down hole tool 2, for instance a drill bit further into the well bore 1. There is at an upper end of the first fluid line 3 and the return fluid line 4 arranged an adapter 101 for guiding the fluids in and out of the two fluid lines 3, 4.

Figure 2:
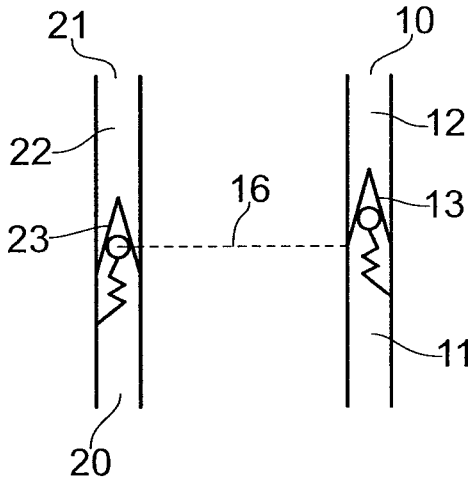
FIG. 2 is a schematic sketch of the principle of the valve device.

In FIG. 2 there is given a first sketch of the principle of a valve device 100 for use in a system as the one described in relation to FIG. 1. The valve device comprises a first inlet 10 and a first outlet 11 with a first flow path 12 between them, for guiding a fluid through the valve device, and a second inlet 20 and a second outlet 21 with a second flow path 22 between them for guiding fluid through the valve device. When implemented physically, the first inlet 10 will normally be connected to the first fluid line 3 (in FIG. 1) and the second outlet 21 will normally be connected to the return fluid line 4 (in FIG. 1) of the system as indicated in FIG. 1. There is in connection with the first flow path 12 arranged a first check valve 13. This check valve 13 is arranged to permit a flow of fluid from the inlet 10 to the outlet 11 when there is a larger pressure at the inlet 10 than at the outlet 11 and this pressure difference exceed a predetermined pressure difference. There is in addition in connection with the second flow path 22 arranged a second check valve 23. This check valve 23 is arranged to initially prevent a flow of fluid from the second outlet 21 to the second inlet 20 when there is a larger pressure at the inlet 20 than the outlet 21. There is between these two check valves 13, 23 provided a connection 16 such that when the first check valve 13 is in an open state, the second check valve 23 will be as a slave valve and also have a state wherein fluid is allowed to flow from the inlet 20 to the outlet 21, passing the second check valve 23. The connection between the first check valve 13 and the second check valve 23 is therefore an override system for the second check valve 23 in the case when the first check valve 13 is in an open state. When there is no override from the first check valve 13 towards the second check valve 23, the second check valve will be in its original state preventing fluid from flowing from the inlet 20 to the outlet 21 of the second flow path 22. There is with this system a possibility of reversing the flow in the return fluid line (4 in FIG. 1) and thereby opening the second check valve 23 by a positive pressure difference between the outlet 21 and the inlet 20 of the second flow path. There may in the system be a possibility that the opening of the second check valve 23 will override the first check valve 13 forcing this to an open position of the first check valve 13 even with a larger pressure at the outlet 11 than the inlet 10 of the first flow path.

Figure 3:
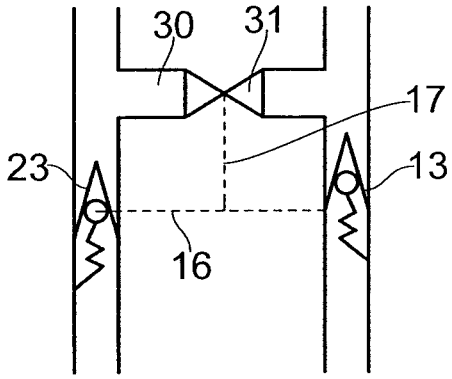
FIG. 3 is a schematic sketch of a second embodiment of the principle.

In FIG. 3 there is given a further schematic embodiment. In this embodiment there is added a fluid connecting path 30 between the first flow path 12 and the second flow path 22. In the shown embodiment the fluid connecting path 30 is connected to the first flow path 12 upstream of the first check valve 13. The fluid connecting path 30 is connected to the second flow path 22 downstream of the second check valve 23. In connection with the fluid connecting path 30 there is arranged a fluid connecting valve 31. This fluid connecting valve 31 may as indicated be connected to the first and second check valves 13, 23. The fluid connecting valve 31 may initially be in an open state and allowing fluid to flow from the first inlet 10 through the fluid connecting path 30 and out of the second outlet 21, giving a possible circulation of a fluid. The fluid connecting valve 31 may then be altered to a second state of a closed position. This will build a pressure in the fluid at the inlet 10 of the first flow path 12. When the pressure at the inlet 10 exceeds the pressure at the outlet 11 with a predetermined value the first check valve 13 will open. The opening of the first check valve 13 will also open the second check valve 23 due to the connection between the two valves 13, 23 through the connection 16. The connection 16 may be an override system which in one embodiment may be a mechanical connection or there may be a pilot pressure line running from the inlet 10. With a pilot pressure line the pressure in the fluid at the inlet 10 will both activate the first and second check valve 13, 23. One may in one instance set the second check valve 23 to open on a somewhat smaller pressure difference than the first check valve 13. This will give a sequence with first closing of the fluid connection path, then opening of the second flow path and thereafter opening of the first flow path. There may also be a connection 17 between the fluid connecting valve 31 and the two check valves 13, 23. This connection may be mechanical, hydraulic or electrical.

Figure 4:
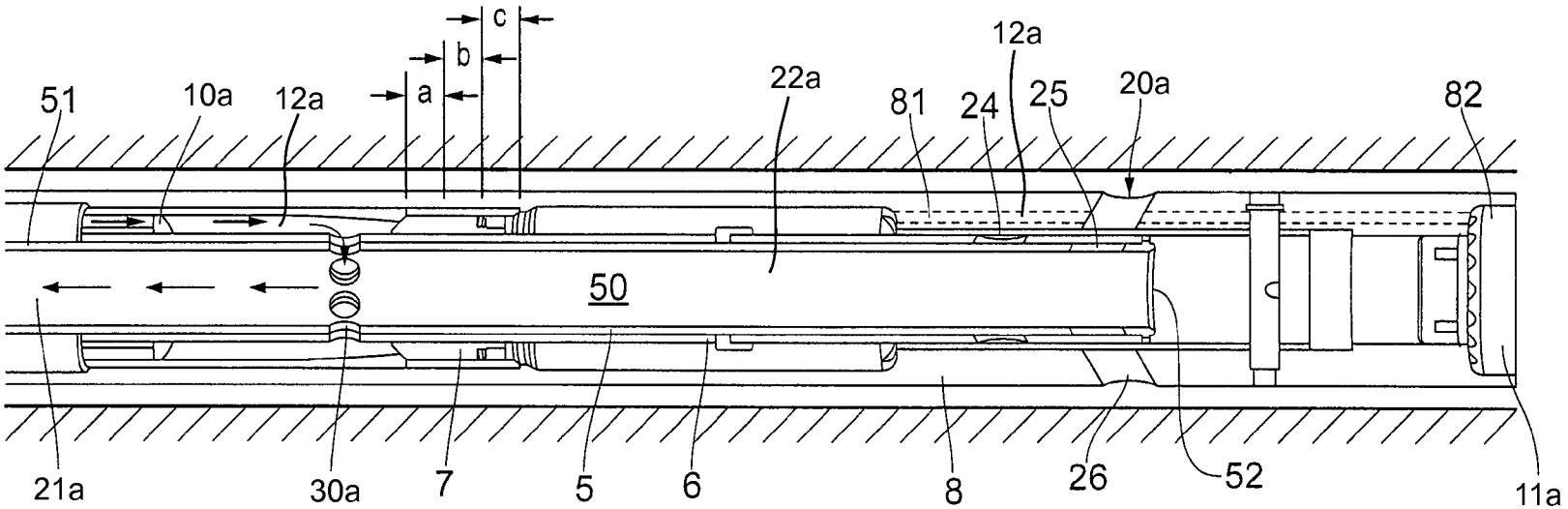
FIG. 4 is a cross section of a valve device according to the invention in an first state and FIG. 5 is a cross section of the valve in FIG. 4 in a second state.
Figure 5:
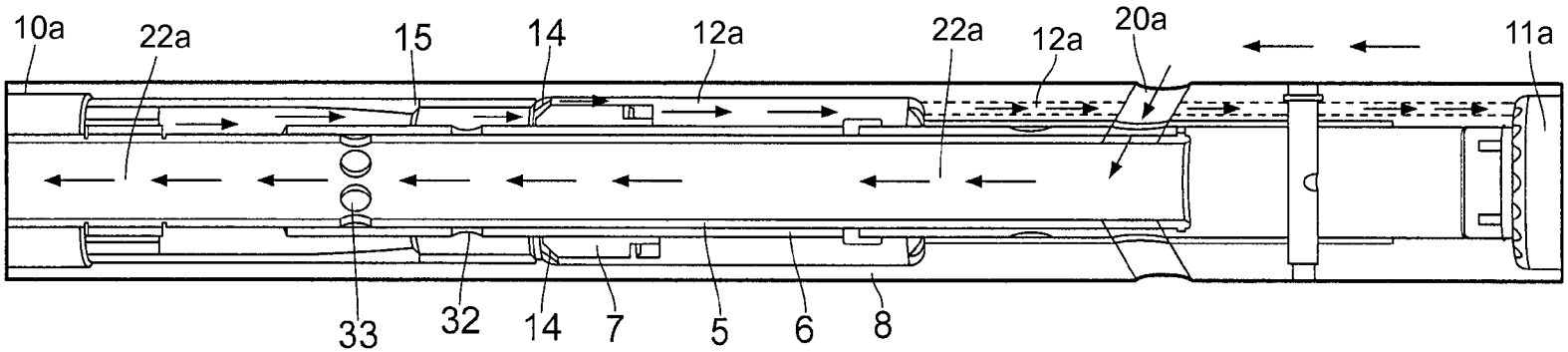

In FIGS. 4 and 5 there is shown one embodiment of a valve device in and first and second state of the valve device. In FIG. 4 the first flow path 12*a* (corresponding to first flow path 12 in FIGS. 2 and 3) and the second flow path 22*a* (corresponding to second flow path 22 in FIGS. 2 and 3) are closed and there is only a flow of fluids possible from the first inlet 10*a* (corresponding to first inlet 10 in FIGS. 2 and 3) through the fluid connecting path 30*a* (corresponding to fluid connecting path 30 in FIG. 3) and to the outlet 21*a* (corresponding to the outlet 21 in FIGS. 2 and 3) as indicated with arrows in FIG. 4.

The valve device comprises an outer sleeve element 8 a middle sleeve element 6 and an inner sleeve element 5. The outer sleeve element 8 is on the outside facing a annular space between the valve device and the well bore when the valve device is positioned within a well bore, as indicated in FIG. 4. Within the outer sleeve element 8, the middle sleeve element 6 is arranged to be movable in an axial direction, mainly in parallel with an axial direction of a well bore. The middle sleeve element 6 is also positioned between the outer sleeve element 8 and the inner sleeve element 5. The middle sleeve element 6 comprises a sealing sleeve part 7. This sealing sleeve part 7 comprises a first sealing surface 14 which will interact with a first valve seat surface 15 formed in an inner surface of the outer sleeve element 8. The interaction between the first sealing surface 14 and the first valve seat surface 15 will close off the first flow path 12*a* through the valve device. The first flow path 12*a* is formed partly by a space between the outer sleeve element 8 and the middle sleeve element 6, and partly by bores 81 in the outer sleeve element 8. The bores 81 lead from the annular space between the outer sleeve element 8 and the middle sleeve element 6 to a centrally located space 82 forming the outlet 11*a* of the first flow path 12 through the valve device. The outer sleeve element 8 has in part of its length a trapped inner surface, forming the valve seat surface 14. The valve seat surface 14 is positioned on the inner surface a distance from both ends of the annular space formed between the outer sleeve element 8 and the middle sleeve element 6. The sealing sleeve part 7 is attached or formed as a part of the middle sleeve element 6. The sealing sleeve part 7 extends into the annular space between the middle sleeve part 6 and the outer sleeve part 8 and forms in an outer section a sealing surface 14. By movement of the middle sleeve element 6 relative the outer sleeve element 8 the first valve 13 is in an open or closed position, shown closed in the first state of the valve device as indicated in FIG. 4 and shown open in the second state as indicated in FIG. 5. The first sealing surface 14, the valve seat surface 15, and the middle sleeve element 6 provide the first valve functionality (corresponding to first valve 13 of FIGS. 2 and 3) for controlling flow of fluid through the first flow path 12*a*.

The middle sleeve element 6 further comprises several holes through the wall of the middle sleeve element 6. One set of these are openings 32 (in FIG. 5) arranged in the middle sleeve element 6 close to the sealing sleeve part 7. These openings 32 are formed in the middle sleeve element 6 upstream of the sealing sleeve part 7 in the first flow path 12*a* through the valve device. In the second state of the valve device, as indicated in FIG. 5 these openings 32 are moved away from openings 33 formed in the inner sleeve element 5, thereby closing off the fluid connecting path 30*a* (in FIG. 4) between the first flow path 12*a* and the second flow path 22*a*. In a second state the openings 32 of the middle sleeve part 6 are aligned with the openings 33 of the inner sleeve element 5, thereby openings the fluid connecting path 30, as shown in FIG. 4. The holes 32, 33 and the middle sleeve element 6 provide the fluid connecting valve functionality (corresponding to fluid connecting valve 31 in FIG. 3) for controlling flow of fluid between the first flow path 12*a* and the second flow path 22*a*.

The middle sleeve part 6 further comprises a set of openings 24. These openings 24 are formed in a part of the middle sleeve part 6 which in a second state of the valve device, FIG. 5, are aligned with openings 25 in the inner sleeve element 5, close to a second end 52 of the inner sleeve element 5, and openings 26 in the outer sleeve element 8, forming the inlet 20*a* (corresponding to second inlet 20 in FIGS. 2 and 3) of the second flow path 22*a* through the valve device. An inner space 50 of the inner sleeve element 5 forms part of the second flow path through the valve device. One end 51 of the inner sleeve element 5 forms the second outlet 21*a* (corresponding to outlet 21 in FIGS. 2 and 3). The opposite second end 52 of the inner sleeve 5 is closed, thereby establishing the second flow path 22*a*. In a first state of the valve device, FIG. 4, the openings 26 of the outer sleeve element 8 and the openings 25 of the inner sleeve element 5 are moved away from the openings 24 of the middle sleeve element 6, thereby closing the second flow path 20 as the second check valve. The holes 24, 25, 26 and the middle sleeve element 6 provide the second valve functionality (corresponding to second valve 23 of FIGS. 2 and 3) for controlling flow of fluid from the first flow path 12*a* to the second flow path 22*a*.

The middle sleeve element 6 with the sealing sleeve part 7 forms a common closure element first valve (14, 15), second valve (24, 25, 26), and the fluid connecting valve (32, 33), thereby giving a mechanical connection between the three valves. When moving the middle sleeve element 6 the movement will in a first part of the movement, indicated with (a) in FIG. 4, close the fluid connecting valve (i.e., by misaligning holes 32, 33), thereafter the movement (b) will open the second valve (i.e., by aligning holes 24, 25, 26) and then at last the movement (c) will open the first valve (i.e., by interaction between the first sealing surface 14 and the valve seat surface 15). The second valve may instead of being a sleeve valve as shown be formed by a different kind of valve, for instance a plug connected to the end of the middle sleeve element 6, which plug for instance may close off the second end 52 of the inner sleeve element 5. The connection between such a plug element and the part of the middle sleeve element 6 forming part of the fluid connecting path 30 and the sealing sleeve part 7, may instead of a sleeve be formed by at least one rod. The rod may be formed to both specifically handle pressure and tension or just one of these forces with only a minor force of the other kind.

The invention has now been explained with reference to embodiments. A skilled person will understand that there may be made alterations and modifications to the embodiments that are within the scope of the invention as defined in the attached claims.

The invention claimed is:

1. A valve device for use with a down hole tool, comprising:

a first inlet, a first outlet, and a first flow path extending between the first inlet and the first outlet;

a second inlet, a second outlet, and a second flow path extending between the second inlet and the second outlet;

a first valve for controlling flow of fluid through the first flow path, wherein the first flow path extends between a first sleeve and a second sleeve, and wherein the second sleeve is arranged within the first sleeve and is axially movable relative to the first sleeve;

a second valve for controlling flow of fluid from the first flow path to the second flow path, wherein the second flow path extends through a third sleeve that is arranged within the second sleeve; and a common closure element linking the first valve and the second valve and operable to adjust a position of each of the first and second valves such that the second valve is in an open position when the first valve is in an open position.

2. The valve device of claim 1, wherein the second sleeve provides the common closure element and axial movement of the second sleeve controls opening and closing of the first and second valves.

3. The valve device of claim 2, wherein the first valve comprises a sealing surface formed on the second sleeve and a valve seat surface formed on the first sleeve, and wherein the sealing surface and valve seat surface can be arranged to permit or block flow of fluid through the first flow path by axial movement of the second sleeve.

4. The valve device of claim 2, wherein the second valve comprises at least a first opening in each of the first sleeve, the second sleeve, and the third sleeve, and wherein the first openings can be arranged to permit or block flow of fluid from the first flow path into the second flow path by axial movement of the second sleeve.

5. The valve device of claim 2, further comprising a third valve for controlling flow of fluid between the first and second flow paths, wherein the common closure element links the first, second, and third valves and is operable to adjust a position of the third valve such that when the first and second valves are closed the third valve is open.

6. The valve device of claim 5, wherein the third valve comprises at least a second opening in each of the second sleeve and third sleeve, and wherein the second openings can be arranged to permit or block flow of fluid between the first and second flow paths by axial movement of the second sleeve.

7. A down hole tool, comprising:

a first fluid line;

a return line arranged centrally within the first fluid line;

a first inlet, a first outlet, and a first flow path extending between the first inlet and the first outlet, the first inlet being in communication with the first fluid line;

a second inlet, a second outlet, and a second flow path extending between the second inlet and the second outlet, the second outlet being in communication with the return line;

a first valve for controlling flow of fluid through the first flow path, wherein the first flow path extends between a first sleeve and a second sleeve, and wherein the second sleeve is arranged within the first sleeve and is axially movable relative to the first sleeve;

a second valve for controlling flow of fluid from the first flow path to the second flow path, wherein the second flow path extends through a third sleeve that is arranged within the second sleeve; and a common closure element linking the first valve and the second valve and operable to adjust a position of each of the first and second valves such that the second valve is in an open position when the first valve is in an open position.

8. The down hole tool of claim 7, further comprising a third valve for controlling flow of fluid between the first and second flow paths, wherein the common closure element links the first, second, and third valves and is operable to adjust a position of the third valve such that when the first and second valves are closed the third valve is open.

9. The valve device of claim 7, wherein the second sleeve provides the common closure element and axial movement of the second sleeve controls opening and closing of the first, second, and third valves.

* * * * *